US011127517B2

(12) United States Patent
Kwon et al.

(10) Patent No.: US 11,127,517 B2
(45) Date of Patent: Sep. 21, 2021

(54) COIL COMPONENT

(71) Applicant: SAMSUNG ELECTRO-MECHANICS CO., LTD., Suwon-si (KR)

(72) Inventors: Soon Kwang Kwon, Suwon-si (KR); Joong Won Park, Suwon-si (KR); Young Seuck Yoo, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 334 days.

(21) Appl. No.: 16/059,626

(22) Filed: Aug. 9, 2018

(65) Prior Publication Data

US 2019/0198211 A1 Jun. 27, 2019

(30) Foreign Application Priority Data

Dec. 27, 2017 (KR) ..... 10-2017-0180630

(51) Int. Cl.
*H01F 3/14* (2006.01)
*H01F 27/30* (2006.01)
(Continued)

(52) U.S. Cl.
CPC ..... *H01F 3/14* (2013.01); *H01B 3/40* (2013.01); *H01F 27/263* (2013.01);
(Continued)

(58) Field of Classification Search
CPC ..... H01F 3/00; H01F 3/08; H01F 3/12; H01F 3/14; H01F 17/04; H01F 17/043;
(Continued)

(56) References Cited

U.S. PATENT DOCUMENTS 4,305,056 A * 12/1981 Mochida ..... H01F 3/14 29/606
5,117,215 A * 5/1992 Kakehashi ..... H01F 3/14 336/178
(Continued)

FOREIGN PATENT DOCUMENTS

JP 08051032 A * 2/1996
JP 2003318036 A * 11/2003
(Continued)

*Primary Examiner* — Tszfung J Chan
(74) *Attorney, Agent, or Firm* — Morgan, Lewis & Bockius LLP

(57) ABSTRACT

A coil component includes a body having a winding type coil and a core in which the winding type coil is embedded, and external electrodes disposed on external surfaces of the body. The core includes first and second cores, and the first and second cores are coupled to each other with a bonding surface interposed therebetween. The bonding surface is formed of a same type of resin as the first and second cores. The first and second cores each include a resin directly covering surfaces of magnetic powder particles, such that adjacent particles are separated only by the resin. A method of manufacturing the coil component includes applying a solvent to dissolve a resin on a bonding surface of the first core, and mounting the second core to the bonding surface having the solvent applied thereto.

21 Claims, 6 Drawing Sheets

(51) Int. Cl.

| | |
|---|---|
| ***H01B 3/40*** | (2006.01) |
| ***H01F 27/26*** | (2006.01) |
| *H01F 27/255* | (2006.01) |
| *H01F 1/153* | (2006.01) |
| *H01F 1/147* | (2006.01) |

(52) U.S. Cl.
CPC ..... *H01F 27/306* (2013.01); *H01F 1/14708* (2013.01); *H01F 1/14791* (2013.01); *H01F 1/15325* (2013.01); *H01F 27/255* (2013.01)

(58) Field of Classification Search
CPC ..... H01F 27/24; H01F 27/255; H01F 27/306; H01F 2038/426
USPC ..... 336/178, 212, 221, 233
See application file for complete search history.

(56) References Cited

U.S. PATENT DOCUMENTS

| | | | | |
|---|---|---|---|---|
| 5,528,113 | A * | 6/1996 | Boys | H01F 38/14 318/16 |
| 2003/0222749 | A1* | 12/2003 | Kung | H01F 27/292 336/192 |
| 2008/0237532 | A1* | 10/2008 | Moro | H01F 1/26 252/62.51 C |
| 2010/0171580 | A1* | 7/2010 | Abe | H01F 3/14 336/178 |
| 2014/0285304 | A1* | 9/2014 | Yoo | H01F 41/046 336/200 |
| 2014/0286814 | A1* | 9/2014 | Kotani | C22C 19/03 419/30 |
| 2018/0182531 | A1* | 6/2018 | Muneuchi | H01F 17/04 |

FOREIGN PATENT DOCUMENTS

| | | | | |
|---|---|---|---|---|
| JP | 2006-324562 | A | 11/2006 | |
| JP | 2011-009644 | A | 1/2011 | |
| JP | 2014-082382 | A | 5/2014 | |
| WO | WO-2016167198 | A1 * | 10/2016 | H01F 27/2823 |

* cited by examiner (X5) (X20)

(X5) (X20)

COIL COMPONENT

CROSS-REFERENCE TO RELATED APPLICATION

This application claims benefit of priority to Korean Patent Application No. 10-2017-0180630 filed on Dec. 27, 2017 in the Korean Intellectual Property Office, the disclosure of which is incorporated herein by reference in its entirety.

BACKGROUND

1. Field

The present disclosure relates to a coil component, and more particularly, to a winding type power inductor.

2. Description of Related Art

In recent years, the miniaturization and multifunctionalization of electronic devices has promoted the development of miniaturized inductor elements. Moreover, portable electronic devices such as smartphones require increasingly high levels of current due to various functions. Portable devices obtain operating power of various voltages necessary for operation of internal circuits using a power circuit such as a DC-DC converter, and inductors used in the circuits are commonly formed of a material having characteristics of suppressing magnetic saturation and having high magnetic permeability to provide high inductance. Since inductance of inductors is proportional to magnetic permeability, inductors having high inductance may be manufactured with a material having high magnetic permeability so as to provide a same level of characteristic inductance with a relatively smaller number of turns, as compared with the use of a material having low magnetic permeability. However, even with the material having high magnetic permeability, the generation of an air gap within an inductor increases magnetic resistance and thereby causes a reduction in magnetic permeability. Here, the use of a material having high magnetic permeability is less affected by an air gap such that the decrement in magnetic permeability is reduced relative to the use of a material having low magnetic permeability. However, in a case in which there is a limitation in selecting a material of high magnetic permeability for enhancement of magnetic permeability, an air gap generally needs to be minimized.

SUMMARY

An aspect of the present disclosure may provide a coil component having a structure for minimizing an air gap inside a core in which a winding type coil is embedded.

According to an aspect of the present disclosure, a coil component may include a body including a winding type coil and first and second cores disposed above and below the winding type coil, respectively, and connected to each other. First and second external electrodes are disposed on external surfaces of the body and are connected to first and second ends of the winding type coil. A bonding surface is disposed between the first and second cores and is formed of a same type of resin as a resin included in the first and second cores.

According to another aspect of the present disclosure, a method for manufacturing a coil component includes applying a solvent to a bonding surface of a first core, the first core including magnetic material particles and a resin. A coil and a second core are mounted on the first core such that the second core contacts the bonding surface of the first core, and the coil is mounted in a cavity between the first and second cores.

According to a further aspect of the present disclosure, a coil component includes a first core and a second core each formed of magnetic particles and a resin and in contact with each other. The coil component further includes a winding coil disposed in a cavity formed between the first core and the second core. An interface at which the first core and the second core contact each other includes only the magnetic particles, the resin, and an optional air gap.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Exemplary embodiments will now be described in detail with reference to the accompanying drawings.

Hereinafter, a coil component according to exemplary embodiments will be described but the disclosure is not limited thereto.

Figure 1A:
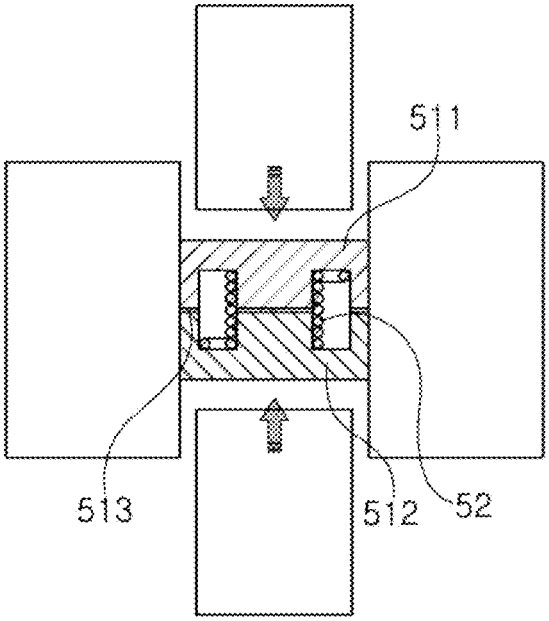
FIGS. 1A through 1C show a coil component of the related art.
Figure 1B:
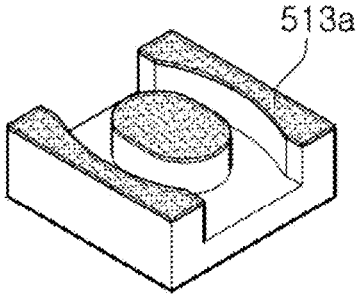
Figure 1C:
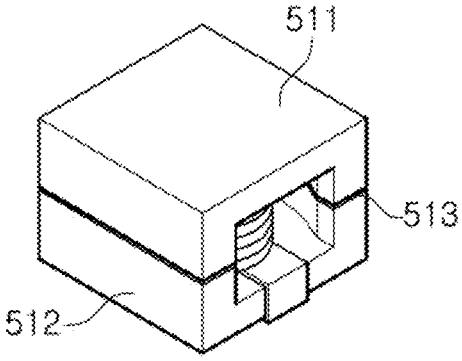

FIGS. 1A through 1D illustrate coil components of the related art. Specifically, FIG. 1A illustrates a process of embedding a winding type coil inside first and second cores by compressing the first and second cores by utilizing a mold, FIG. 1B illustrates only the first core disposed on a lower side, and FIG. 1C is a schematic perspective view illustrating a structure in which the first and second cores are coupled.

Referring to FIG. 1A, a bonding surface (or a joint surface) 513 is inevitably formed between first and second cores 511 and 512 during a process of fixing a predetermined winding type coil 52 between the first core 511 and the second core 512 using a mold or punching.

The bonding surface 513 is generated by a bonding agent (or adhesive) 513*a* for bonding the first and second cores 511 and 512 as illustrated in FIG. 1B. The bonding agent 513*a* may be appropriately selected and various materials may be used as long as they can bond the first and second cores 511 and 512. However, the bonding agent 513*a* generally remains between the first and second cores 511 and 512 even after the first and second cores 511 and 512 are bonded.

Referring to FIG. 1C, the bonding surface 513, which remains with a predetermined thickness between the first and second cores 511 and 512 interferes with smooth flow of magnetic flux generated by the coil and causes a magnetic flux leakage. In addition, there is a high possibility that an air gap having a predetermined thickness is generated in the vicinity of the bonding surface 513 and inductance may be lowered by such an air gap.

The bonding surface 513 and the air gap in the vicinity of the bonding surface may cause a problem regarding insulation reliability between magnetic powders even in an environment where an actual product is used. Furthermore, when the first and second cores are molded using high pressure, a coating layer covering magnetic powder may be damaged in a portion in contact with a mold and the damaged coating layer may lower inductance in a use environment so as to degrade characteristics even in a manufacture environment.

In order to solve the aforementioned problems arising in the related art component of FIGS. 1A through 1C, a coil component 100 according to an example of this disclosure is a modification of the structure of bonding the first and second cores. Hereinafter, a bonding surface between the first and second cores will be largely described.

Figure 2:
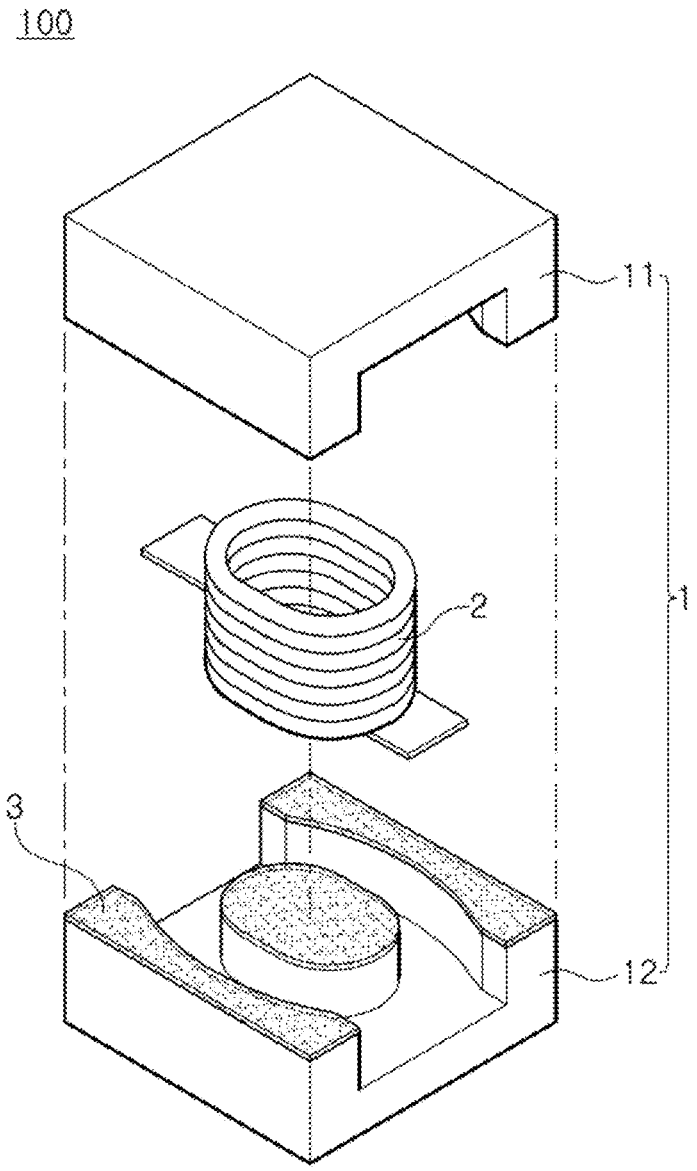
FIG. 2 is a schematic exploded perspective view illustrating a body of a coil component being assembled according to an exemplary embodiment.

FIG. 2 is a schematic exploded perspective view of a body before the body 1 of the coil component 100 according to one example of this disclosure is assembled.

Referring to FIG. 2, in relation to a winding type coil 2, the body 1 includes a first core 11 covering an upper surface of the winding type coil 2 and a second core 12 covering a lower surface of the winding type coil 2. In order for the first and second cores 11 and 12 to be assembled, a medium serving to prevent the first and second cores 11 and 12 from being separated from each other is used. For example, if the first and second cores 11 and 12 are fixed only with high pressure, a sufficient fixing force may not be secured and damage to a coating layer coating (or covering) magnetic powder inside the first and second cores 11 and 12 may be caused. Meanwhile, in a casein which the first and second cores 11 and 12 are fixed using a bonding agent, an air gap may be formed in the vicinity of the bonding agent and flow of magnetic flux may be obstructed due to a remaining bonding agent.

Referring to FIG. 2, a solvent 3 may be disposed on an upper surface of the first core 11. Any solvent may be used as long as it can serve to dissolve a resin included in the first and second cores 11 and 12 and there is no limitation in specific types of solvent. Since the solvent 3 is completely removed in a final coil component, the resin in the first core 11 and the resin in the second core 12 may be directly bonded resultantly.

Figure 3:
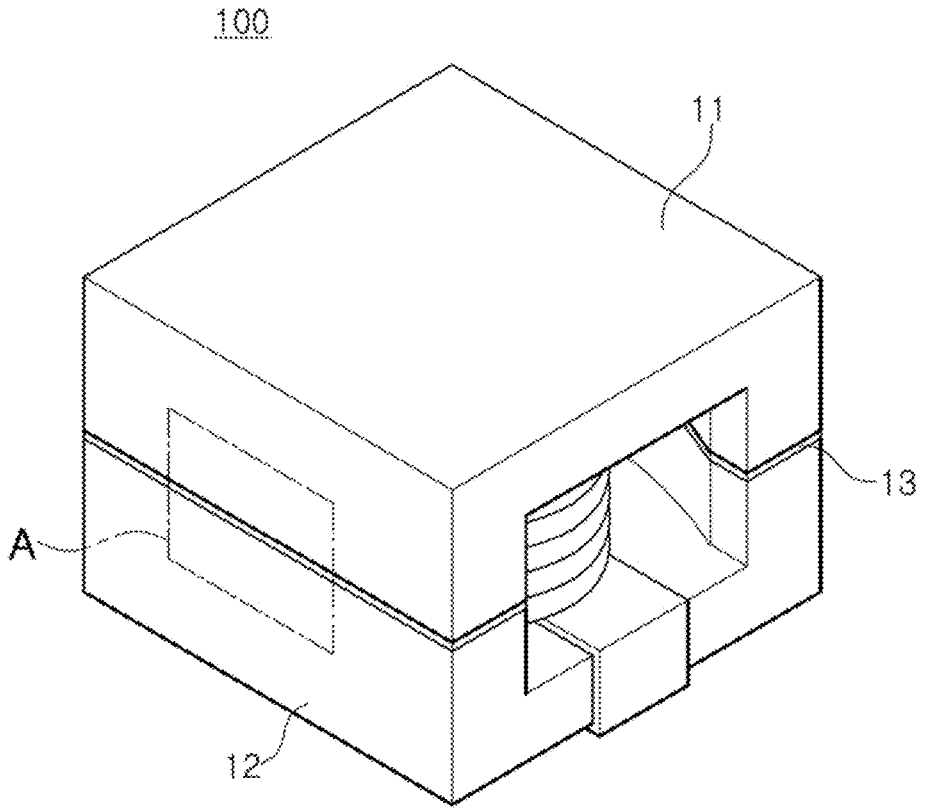
FIG. 3 is a schematic perspective view illustrating an assembled body of a coil component according to an exemplary embodiment.

FIG. 3 is a schematic perspective view of a final coil component 100 after the body of the coil component according to an exemplary embodiment is assembled. Referring to FIG. 3, a bonding surface 13 is formed between the first and second cores 11 and 12. The bonding surface 13 may be distinguished from the bonding surface 513 of FIGS. 1A-1C described above. That is, the bonding surface 513 of FIGS. 1A-1C is a residual bonding agent formed with a material of a composition different from that of the first and second cores 511 and 512, whereas the bonding surface 13 of FIG. 3 is formed by dissolving a resin of the first and second cores by the solvent 3 and subsequently curing the same. In other words, no bonding agent is detected from the bonding surface 13 and a periphery thereof in FIG. 3.

The coil component further includes external electrodes connected to both ends of the winding type coil 2 in the body, and the coil component may be electrically connected to an external component by means of the external electrodes.

Figure 4:
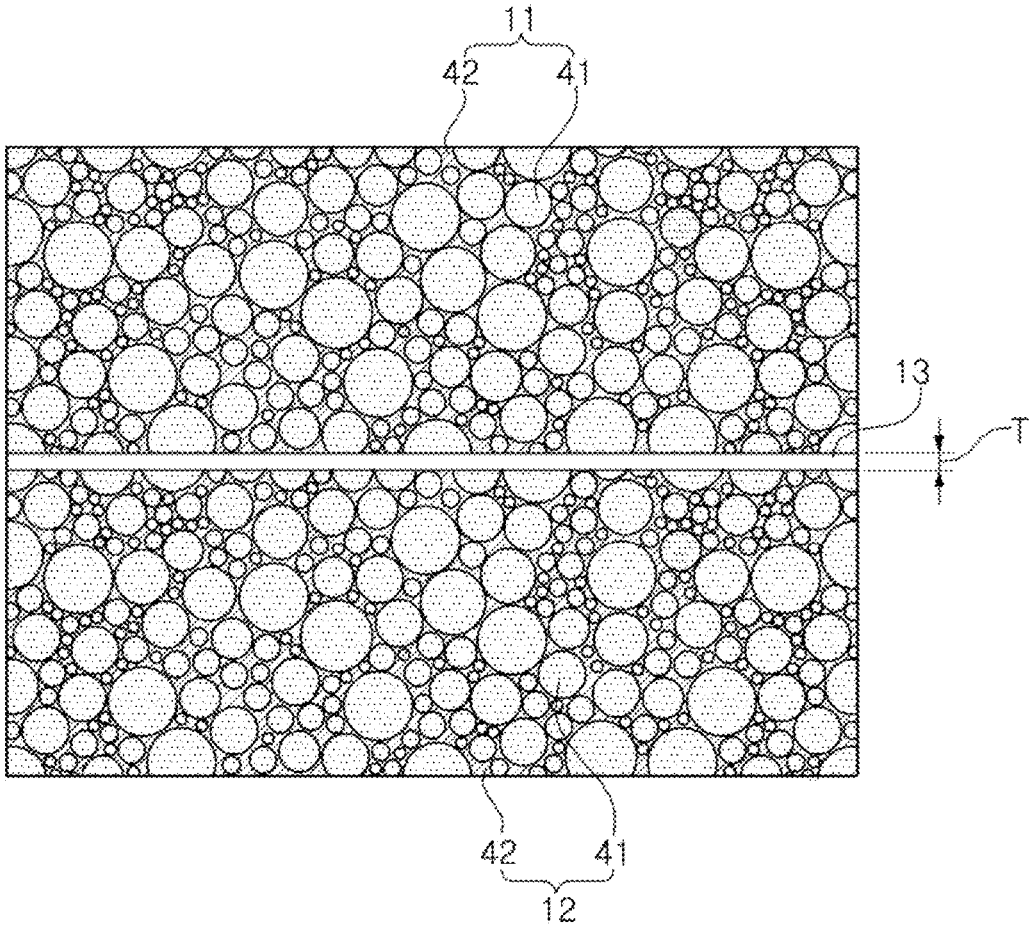
FIG. 4 is a cross-sectional view of a region A of FIG. 3.

FIG. 4 is an enlarged schematic cross-sectional view of a region A of FIG. 3. The inside and the bonding surface of the first and second cores 11 and 12 will be described in detail with reference to FIG. 4.

Referring to FIG. 4, the first and second cores 11 and 12 each include a magnetic powder (or magnetic powder particle(s)) 41 and a resin 42 coating a surface of the magnetic powder 41. Any magnetic powder may be used without limitation as long as it has magnetic properties. For example, the magnetic powder 41 may be formed of at least one selected from among Fe, an Fe-Ni-based alloy, an Fe-Si-based alloy, an Fe-Si-Al-based alloy, an Fe-Cr-Si-based alloy, an Fe-based amorphous alloy, an Fe-Co-based alloy, an Fe-N-based alloy, a MnZn-based ferrite, and a NiZn-based ferrite. In other words, the magnetic powder may be selected without a restriction as long as its particles have magnetic properties. The magnetic powder is directly coated with a resin without a separate oxide layer, such that surfaces of the magnetic powder do not include (e.g., are free of) any separate oxide layer. Here, the separate oxide layer is a separate inorganic layer used for insulating the coating from the magnetic powder and includes any coating layer formed as a portion of the composition inside the magnetic powder that is spread to a surface to react with oxygen, for example.

The content of a residual curing agent or a residual binder in the first and second cores is 0 wt %, apart from the magnetic powder and the resin. This means that, besides the resins constituting the first and second cores, no additional curing agent or binder is added from the outside. Generally, the curing agent, the binder, and the like, are inevitably left in a predetermined amount. However, since the coil component of the present disclosure utilizes the resin coating the magnetic powder as a curing agent and a binder, no additional curing agent or binder is applied.

Any insulating layer other than the resin 42 does not come between the magnetic powder particle 41 and another magnetic powder particle adjacent thereto, which minimizes a distance between the magnetic powder particles in the coil component having a tendency toward miniaturization to maximize magnetic permeability.

The resin 42 is preferably an epoxy resin as a thermosetting resin, and here, various types of epoxy resin may be adopted according to characteristics of the magnetic powder under use. For example, if high resistance insulation properties are required, the epoxy resin may be an epoxy free from a benzene ring.

There is no limitation in the scheme of forming the structure in which the surface of the magnetic powder particle 41 is coated with the resin 42 and only the resin coating the surface of the magnetic powder particle is disposed between adjacent magnetic powder particles, but, for example, when the entirety of the first core or the entirety of the second core is 100 wt %, a weight percent of the resin to the magnetic powder may be 1% to 5%. Magnetic powder exhibiting desired characteristics is selected, and the magnetic powder and the resin are subsequently stirred and mixed by a dry or wet method using a V-shaped mixer, a ball, a mill, a beads mill, and various rotary mixers. Here, mixing is selectively performed from 5 minutes to 200 hours. When stirring is wet stirring, the magnetic powder and the resin may be dried using a fluidized bed dryer or a spray dryer.

Subsequently, in order to bond the first core 11 and the second core 12 prepared through the above-mentioned process, a solvent capable of dissolving the resin used for forming the first and second cores 11 and 12 is prepared. Different types of solvent maybe selected according to the resin in the first and second cores 11 and 12, and a person skilled in the art may appropriately select a solvent in consideration of a manufacturing environment, process requirements, and the like.

The solvent may be disposed on a surface of the first core 11 to come into contact with the second core 12 so that at least a portion of the resin on an upper surface of the first core 11 and at least a portion of the resin on a lower surface of the second core 12 are bonded. The solvent serves to allow the resin in the first and second cores 11 and 12 to be dissolved to act as a driving force to bond the first and second cores. The driving force to bond the first and second cores 11 and 12 acts due to the dissolution by the solvent, and as a result, the resin on the upper surface of the first core 11 and the resin on the lower surface of the second core 12 are cured together to form the integrated core. Additionally, the winding type coil is embedded in the core.

Since the magnetic powder particles 41 are already coated with the resin 42 in the first and second cores 11 and 12 before the solvent is applied, adhesion between the first and second cores 11 and 12 may be maintained although the solvent with low viscosity is applied thin.

When components of the bonding surface 13 are analyzed, the solvent does not remain after the resin is dissolved, and since there is no bonding agent, or the like, added from the outside but the solvent, no component other than the resin cured in the first and second cores is detected. However, the bonding surface is a layer formed by a resin 42 re-cured after being dissolved, set apart from the resin coating the magnetic powder particles 41 in a region excluding the upper surface of the first core 11 and the resin coating the magnetic powder particles in a region excluding the lower surface of the second core 12. Here, the reason for referring to the bonding surface as a "layer" is because the bonding surface 13 is arranged in a strip shape in relation to the L-W cross-section. A layer thickness of the bonding surface 13 is not limited to a great extent and needs not be uniform, but a maximum layer thickness maybe smaller than 1 μm. Substantially, a thickness T of the bonding surface 13 may be defined as a shortest distance between the magnetic powder 41 in the first core 11 and the magnetic powder 41 in the second core 12, and thus, if a maximum layer thickness of the bonding surface 13 is 1 μm or greater, it means that the distance between the magnetic powder particles 41 is so long as to reduce the magnetic permeability characteristic. Although not shown, the bonding surface 13 is formed to extend only in a portion in the length direction and/or the width direction of the body and have a predetermined thickness in a strip shape, rather than formed on the entire interface between the first and second cores. Here, on a portion of the same plane with the bonding surface having the strip shape, a bonding surface formed of a resin is not disposed but a space in which one surface of the first core magnetic powder and one surface of the magnetic powder of the second core are in contact with each other is formed. Contacting between one surface of the first core magnetic powder and one surface of the magnetic powder of the second core means that the first and second cores are in direct contact with each other without an intermediary of the bonding surface therebetween.

Figure 5:
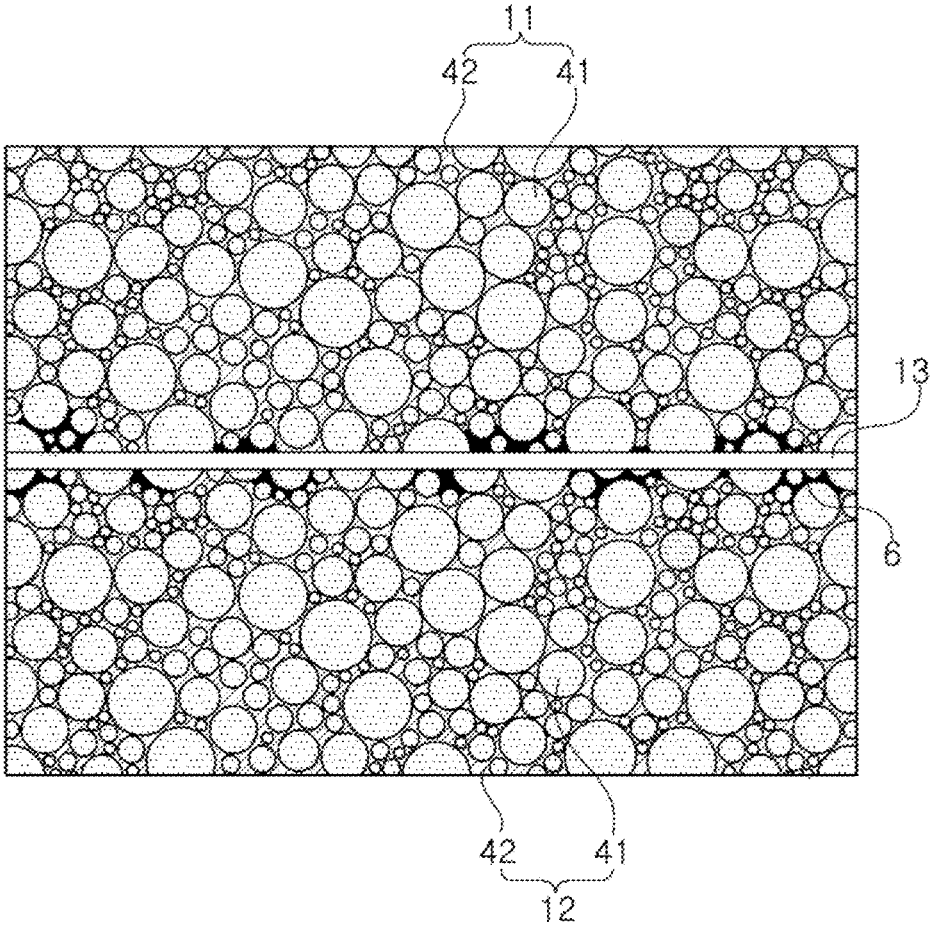
FIG. 5 is a cross-sectional view of a modification of the region A of FIG. 4.

FIG. 5 is a cross-sectional view according to a modification of FIG. 4. In the coil component of FIG. 5, avoid layer 6 is formed around the bonding surface. The void layer 6 may be an air gap that may be generated when an actual coil product is manufactured. As described above, the air gap, preferably to be minimized as a major factor of increasing magnetic resistance, is inevitably formed. In a case in which the first and second cores 11 and 12 are bonded using a bonding agent paste (e.g., 513*a*) in the existing manner, the bonding agent paste is applied to a considerable thickness to ensure a sufficient bonding agent force, resulting in an air gap of a considerable thickness. In contrast, the thickness of the void layer 6 around the bonding surface 13 of the coil component of FIG. 5 is considerably thinner than 1 μm, which does not substantially affect a decrease of inductance. Here, the reason for being able to control the thickness of the void layer 6 in nanoscale is because a portion of the resin 42 constituting the first and second cores 11 and 12 is directly utilized as the bonding surface by applying the solvent capable of dissolving the resin 42 constituting the first and second cores 11 and 12, and thus, there is no need to apply an additional bonding agent to the interface between the first and second cores 11 and 12. Forming the void layer 6 to be thin will be described in more detail with reference to FIGS. 6A and 6B.

Figure 6A:
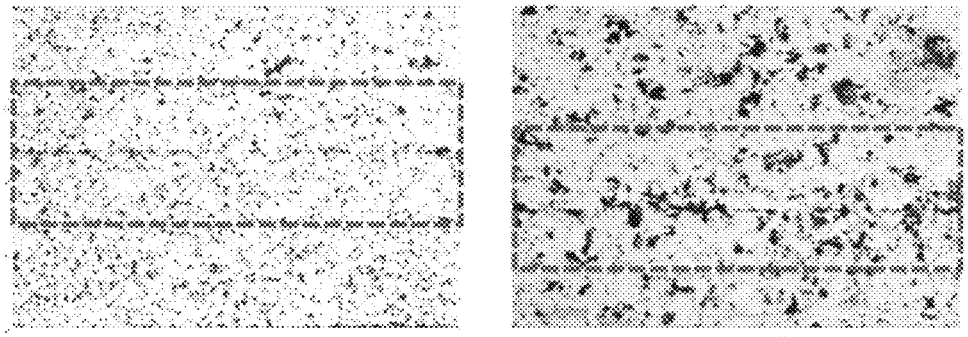
FIG. 6A is an enlarged view of the periphery of a boundary between first and second cores of a coil component of the present disclosure.
Figure 6B:
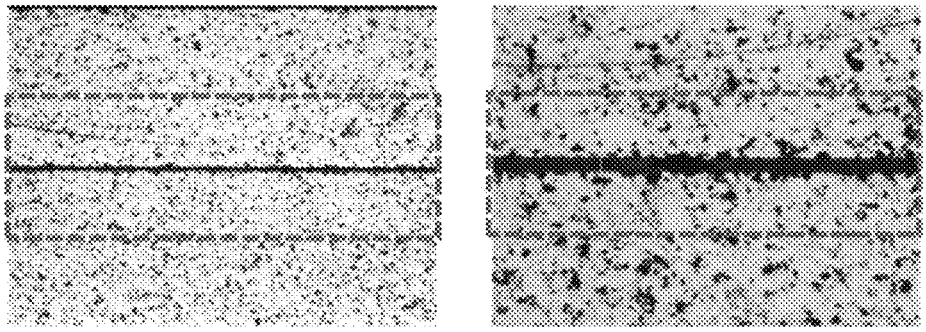
FIG. 6B is an enlarged view of the periphery of a boundary between first and second cores of the related art coil component manufactured according to the method illustrated in FIG. 1.

FIG. 6A shows enlarged views of the periphery of a boundary between first and second cores of a coil component of the present disclosure, and FIG. 6B shows enlarged views of the periphery of a boundary between first and second cores of the related art coil component manufactured according to the method illustrated in FIG. 1. FIGS. 6A and 6B show coil components having a rated 5050 size (5.0 mm in width and 5.0 mm in length).

Referring to FIG. 6A, it can be seen that, although the boundary between the first core and the second core may be apparent through a thin strip-shaped bonding surface, an air gap between the first and second cores is minimized to the extent that it is not distinguished from an air gap formed in the first core and the second core itself.

In contrast, in the case of FIG. 6B, it can be seen that, the boundary between the first and second cores of the related art coil component is conspicuous due to an air gap, and, specifically, an air gap layer of about 23.13 μm is formed around the boundary. In the case of the related art coil component shown in FIG. 6B, it is apparent that inductance will be significantly decreased due to presence of the air gap.

According to the above-described coil component, in a context that it is difficult to develop a coil component having high magnetic permeability and high inductance in spite of the active development of materials having high magnetic permeability, the high inductance coil component with magnetic resistance minimized is provided by forming the bonding surface by dissolving the resin included in the first and second cores and subsequently re-curing the same without adding a separate adhesive.

As set forth above, according to exemplary embodiments described herein, the coil component having a structure of minimizing a chip size, while maximizing inductance and magnetic permeability is provided.

While exemplary embodiments have been shown and described above, it will be apparent to those skilled in the art that modifications and variations could be made without departing from the scope of the present invention as defined by the appended claims.

What is claimed is:

1. A coil component comprising:

a body including a winding type coil and first and second cores disposed above and below the winding type coil, respectively, and connected to each other; and external electrodes disposed on external surfaces of the body and connected to opposing ends of the winding type coil, wherein a bonding surface disposed between the first and second cores is formed of a resin included in at least one of the first or second cores.

2. The coil component of claim 1, wherein the resin is a thermosetting resin.

3. The coil component of claim 2, wherein the thermosetting resin is an epoxy resin.

4. The coil component of claim 1, wherein the first and second cores each include magnetic powder particles and the resin directly covering surfaces of the magnetic powder particles.

5. The coil component of claim 4, wherein adjacent magnetic powder particles, among the magnetic powder particles of the first and second cores, are separated from each other only by the resin.

6. The coil component of claim 4, wherein surfaces of the magnetic powder particles are free of any inorganic layer.

7. The coil component of claim 4, wherein the magnetic powder particles include at least one selected from among Fe, an Fe-Ni-based alloy, an Fe-Si-based alloy, an Fe-Si-Al-based alloy, an Fe-Cr-Si-based alloy, an Fe-based amorphous alloy, an Fe-based nanocrystalline alloy, a Co-based amorphous alloy, a Fe-Co-based alloy, an Fe-N-based alloy, a MnZn-based ferrite, and a NiZn-based ferrite.

8. The coil component of claim 1, wherein a content of a residual curing agent or residual binder, different from the resin, inside the first and second cores is 0 wt %.

9. The coil component of claim 1, further comprising:

a void layer between the first and second cores.

10. The coil component of claim 9, wherein the void layer is an air gap.

11. The coil component of claim 9, wherein a maximum thickness of the void layer, corresponding to a maximum distance between the first and second cores, is less than 1 μm.

12. The coil component of claim 1, wherein the bonding surface is free of a separate bonding agent different from the same type of resin as the resin included in the first and second cores.

13. The coil component of claim 1, wherein the body includes first and second side surfaces opposing each other in a width direction, first and second end surfaces opposing each other in a length direction, and upper and lower surfaces opposing each other in a thickness direction, and the body has a 5050 size having a width of 5.0 mm and a length of 5.0 mm.

14. The coil component of claim 1, wherein the resin of the first core and the resin of the second core are in direct contact with each other.

15. The coil component of claim 1, wherein the bonding surface includes a cured epoxy.

16. The coil component of claim 1, wherein the bonding surface has a strip shape having a predetermined thickness.

17. A coil component comprising:

a first core and a second core each formed of magnetic particles and a resin and in contact with each other; and a winding coil disposed in a cavity formed between the first core and the second core, wherein an interface at which the first core and the second core contact each other includes only the magnetic particles, the resin of at least one of the first core or the second core, and an optional air gap.

18. The coil component of claim 17, wherein at the interface at which the first core and the second core contact each other, only the resin and the optional air gap are provided between magnetic particles of the first core and magnetic particles of the second core.

19. The coil component of claim 17, wherein in the first core and the second core, the resin is disposed directly on surfaces of the magnetic particles.

20. The coil component of claim 18, wherein surfaces of the magnetic particles of the first core and the second core are free of any oxide.

21. The coil component of claim 17, wherein a surface of the first core is less than 1 μm from a surface of the second core.

* * * * *